US005874867A

United States Patent [19]

Oguma et al.

[11] Patent Number: 5,874,867

[45] Date of Patent: Feb. 23, 1999

[54] WAVEGUIDE HYBRID JUNCTION

[75] Inventors: Nobuhiko Oguma; Tsunehisa Marumoto, both of Tokyo, Japan

[73] Assignee: NEC Corporation, Tokyo, Japan

[21] Appl. No.: 859,105

[22] Filed: May 20, 1997

[30] Foreign Application Priority Data

May 27, 1996 [JP] Japan ..... 8-131500

[51] Int. Cl.[6] ..... H01P 5/18

[52] U.S. Cl. ..... 333/113; 333/117

[58] Field of Search ..... 333/113, 114

[56] References Cited

U.S. PATENT DOCUMENTS

| | | | |
|---|---|---|---|
| 2,905,902 | 9/1959 | Strandberg | 333/113 X |
| 3,858,123 | 12/1974 | Ohta et al. | 333/113 X |
| 5,043,684 | 8/1991 | Downs et al. | 333/111 |
| 5,266,911 | 11/1993 | Perpall et al. | 333/113 X |

FOREIGN PATENT DOCUMENTS 1 370 229 10/1974 United Kingdom .

OTHER PUBLICATIONS

Riblet, Henry J., "The Short–Slot Hybrid Junction", *Proceedings of the I.R.E.,* pp. 180–184.

*Primary Examiner*—Paul Gensler
*Attorney, Agent, or Firm*—Young & Thompson

[57] ABSTRACT

A wavegide hybrid junction includes a coupling section, a coupling hole, and an external cavity resonator. The coupling section is formed by removing by a predetermined length part of a common narrow side wall for isolating two rectangular waveguides. The coupling hole is formed in the upper wall of a waveguide so as to communicate with the coupling section. The external cavity resonator externally cover the coupling hole.

13 Claims, 7 Drawing Sheets

WAVEGUIDE HYBRID JUNCTION

BACKGROUND OF THE INVENTION

1. Field of the Invention

The present invention relates to a waveguide hybrid junction and, more particularly, to a waveguide hybrid junction serving as a short-slot type directional hybrid junction.

2. Description of the Prior Art

As shown in prespective view of FIG. 1, a conventional waveguide hybrid junction is constituted by a waveguide 10 which is prepared by arranging two rectangular waveguides parallel through one side wall surface and has a small coupling section 21 formed by partially cutting the side wall surface. The waveguide 10 has four terminals 1, 2, 3, and 4 as directional coupling I/O terminals. A waveguide hybrid junction with this arrangement is generally called a short-slot directional hybrid junction.

The basic operation of this waveguide hybrid junction will be explained by dividing its area into three areas 1 to 3, i.e., the area of the coupling section 21 and areas before and after the coupling section 21, as shown in FIG. 2.

First, when a radio wave of $TE_{10}$ mode is excited at the terminal 1 of the area 1, radio waves of $TE_{10}$ and $TE_{20}$ modes are excited in the area 2. If a length L of the coupling section 21 (area 2) is so selected as to obtain a phase shift difference of about 90° between the $TE_{10}$ and $TE_{20}$ modes, radio waves of $TE_{10}$ mode having almost the same amplitude value and a phase shift difference of about 90° are excited at the terminals 3 and 4. As a result, in the waveguide hybrid junction, for example, a radio wave incident from the terminal 1 is output to not the terminal 2 but the terminals 3 and 4, and a radio wave incident from the terminal 3 is similarly output to the terminals 1 and 2.

The frequency vs. phase shift characteristics and amplitude characteistics of this waveguide hybrid junction will be described below.

Of parameters S between these four terminals, $S_{31}$ represents coupling from the terminal 1 to the terminal 3, and $S_{41}$ represents coupling fromthe terminal 1 to the terminal 4. Under perfect match conditions, $S_{31}$ and $S_{41}$ are given by the following equations:

$$S_{31} = \frac{e^{-j\theta_4}}{2}\,(1 + e^{-j\theta}) \tag{1}$$

$$S_{41} = \frac{e^{-j\theta_4}}{2}\,(1 - e^{-j\theta}) \tag{2}$$

A phase shift difference between radio waves at the terminals 3 and 4 input from the terminal 1 is expressed by Θ.

$$\Theta = \Delta\theta - 2\Delta\phi \tag{3}$$

$$\Delta\theta = \theta_3 - \theta_4 \tag{4}$$

$$\Delta\phi = \phi_{13} - \phi_{14} \tag{5}$$

$$\theta_3 = \int_{-\frac{L}{2}}^{\frac{L}{2}} \beta_3(z)dz \tag{6}$$

$$\theta_4 = \int_{-\frac{L}{2}}^{\frac{L}{2}} \beta_4(z)dz \tag{7}$$

where $\beta_3(z)$ and $\beta_4(z)$ are phase constants in the $TE_{10}$ and $TE_{20}$ modes at a coupling portion A, respectively.

In the above equations, $\theta_3$ and $\theta_4$ represent propagation phase shift amounts in $TE_{10}$ and $TE_{20}$ modes at the coupling portion 21, respectively.

First, the phase shift characteristics will be described.

FIG. 3A is a graph showing the frequency characteristic of a difference $\Delta=\theta_3-\theta_4$ (solid line) between the phase shift amounts at the coupling section 21 (to be referred to as the coupling portion A hereinafter) of the waveguide hybrid junction having the shape shown in FIG. 1, and that of a difference $2\Delta\phi=2\ (\phi_{13}-\phi_{14})$ (broken line) between the phase shift amounts at discontinuous portions 22 and 23 (to be referred to as discontinuous portions B and B' hereinafter). As described above, the length L of the coupling portion A is selected such that $\Delta\theta=\theta_3-\Delta_4$ becomes almost 90° within the frequency range of $f_1$ to $f_2$ as a target range of this waveguide hybrid junction, as shown in FIG. 3A.

$\phi_{13}$ and $\phi_{14}$ represent phase shift amounts in the $TE_{10}$ and $TE_{20}$ modes, respectively. A difference between the phase shift amounts in the $TE_{10}$ and $TE_{20}$ modes generated at the corresponding discontinuous portions B and B' is given by $\Delta\phi=\phi_{13}-\phi_{-}$.

A radio wave input from the terminal 1 is output to the terminal 4 through the two discontinuous portions (B and B'). For this reason, the difference between the phase shift amounts in the $TE_{10}$ and $TE_{20}$ modes generated at the discontinuous portions between the input and output of the short-slot hybrid is $2\Delta\phi$. The characteristic indicated by the broken line in FIG. 3A is obtained.

The phase shift difference Θ generated when radio waves of the respective modes input from the terminal 1 are output to the terminals 3 and 4 is calculated from a difference between the phase shift difference Δθgenerated at the coupling portion A and the phase shift difference $2\Delta\phi$generated at the discontinuous portions B and B',i.e., $\Theta=\Delta\theta-2\Delta\Theta$.

FIG. 3B is a graph showing the frequency characteristics of Θ obtained by this calculation. As is apparent from FIG. 3B, the phase shift difference is almost 90° within the frequency band of $f_1$ to $f_2$.

Next, the amplitude characteristics will be described.

An amplitude characteristic $|S_{31}|$ for coupling from the terminal 1 to the terminal 3 and an amplitude characteristic $|S_{41}|$ for coupling from the terminal 1 to the terminal 4 are obtained by substituting Θ prepared by the above calculation into equations (1) and (2), respectively. The frequency characteristics of these amplitude characteristics are shown in FIG. 4.

Referring to FIG. 4, both the amplitude characteristics $|S_{31}|$ and $|S_{41}|$ have a loss of about −3 dB within the limited frequency band of $f_1$ to $f_2$, and a signal input from the terminal 1 is distributed almost half and half to the terminals 3 and 4.

The conventional waveguide hybrid junction described above is shown in, e.g., reference: Fumikazu Oguchi "Microwave and Millimeter Wave", pp. 303–305.

The conventional waveguide hybrid junction has a compact, relatively simple structure. Further, good characteristics can be ensured over a relatively broad band.

Referring to FIGS. 3B and 4, the amplitude and phase shift characteristics respectively have a loss of about 3 d B and a phase shift difference of almost 90° within the limited frequency band of $f_1$ to $f_2$, as described above. However, at, e.g., a frequency $f_1'$ lower than the frequency $f_1$ in FIG. 4, the distribution ratio of the amplitude characteristics $|S_{31}|$ and $|S_{41}|$ greatly differs from −3 d B. Also in FIG. 3B, the phase shift difference Θ greatly differs from 90° in the frequency band of $f_1'$ to $f_1$.

In this manner, although the conventional waveguide hybrid junction exhibits good characteristics within a frequency band determined by the shape of the waveguide, it greatly degrades at a lower frequency and therefore cannot be used. In particular, transmission of multimedia signals, transmission of broad-band ISDN signals, and the like are requiring waveguide hybrid junctions with better characteristics. The above degradation in signal characteristics in a low frequency band poses a problem.

SUMMARY OF THE INVENTION

The present invention has been made in consideration of the situations of the prior art, and has as its object to provide a waveguide hybrid junction which can attain a broad band by adjusting a phase difference Θ at a terminal on a side opposite to a power incident side to 90° even in the frequency band of $f_1$ ' to $f_1$.

To achieve the above object, according to the first basic aspect of the present invention, there is provided a waveguide hybrid junction comprising a coupling section formed by removing by a predetermined length part of a common narrow side wall for isolating two rectangular waveguides, a coupling hole formed in an upper wall of a waveguide so as to communicate with the coupling section, and an external cavity resonator for externally covering the coupling hole.

In the first basic aspect, sizes of the coupling hole and the external cavity resonator are adjusted to compensate amlitude and phase shift-to-frequency characteristics of the waveguide.

In the first basic aspect, the external cavity resonator is arranged at a substantially central portion of the coupling section in a direction perpendicular to the common narrow side wall.

To achieve the above object, according to the second basic aspect of the present invention, there is provided a waveguide hybrid junction comprising a coupling section formed by removing by a predetermined length part of a common narrow side wall for isolating two rectangular waveguides, first and second coupling holes formed in an upper wall of a waveguide so as to communicate with the coupling section, and first and second externally cavity resonators for externally covering the first and second coupling holes.

In the second basic aspect, sizes of the first and second coupling holes and the first and second external cavity resonators are adjusted to compensate amplitude and phase shift-to-frequency characteristics of the waveguide.

In the second basic aspect, the first and second external cavity resonators are arranged at substantially central portions of the coupling section in a direction perpendicular to the common narrow side wall.

In the second basic aspect, the first and second external cavity resonators are arranged parallel to each other to be spaced apart by ¼ an intra-waveguide wavelength at the coupling section in a $TE_{10}$ mode.

In the first and second basic aspects, the predetermined length of the coupling section is set such that a phase shift difference caused at the coupling section becomes almost 90°.

In the first and second basic aspects, the coupling section has a matching element. With this arrangement, the frequency band can be further broadened.

As can be easily understood from the above aspects, according to the present invention, a waveguide hybrid junction having a frequency band broader than a conventional one can be provided only by adding an external cavity resonator. By attaching two external cavity resonators, there can be provided a waveguide hybrid junction having good frequency-to-phase shift and amplitude characteristics free from any influence of reflection. By adding an external cavity resonator and a matching element, the frequency band can be further broadened.

The above and many other objects, features and advantages of the present invention will become manifest to those skilled in the art upon making reference to the following detailed description and accompanying drawings in which preferred structural embodiments incorporating the principles of the present invention are shown by way of illustrative example.

DETAILED DESCRIPTION OF PREFERRED EMBODIMENTS

Several preferred embodiments of the present invention will be described below with reference to the accompanying drawings.

Figure 5:
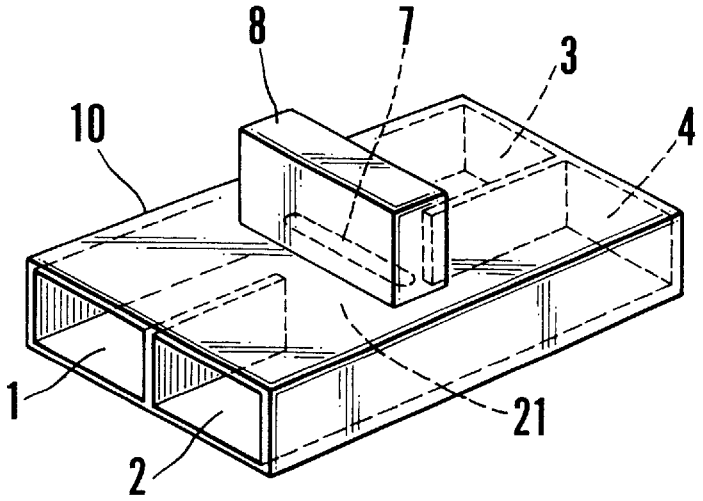
FIG. 5 is a perspective view schematically showing the outer appearance of a waveguide hybrid junction according to the first embodiment of the present invention.

FIG. 5 is a perspective view schematically showing the outer appearance of a waveguide hybrid junction according to the first embodiment of the present invention. In FIG. 5, similar to the conventional waveguide hybrid junction, the waveguide hybrid junction of the present invention uses a waveguide 10 which is prepared by arranging two rectangular waveguides so as to be adjacent to each other through one wall and which has a coupling section 21 formed by partially cutting the wall surface, and four terminals 1, 2, 3, and 4. The arrangement of this waveguide hybrid junction is different from the conventional one in that a small coupling hole 7 is formed in a wide upper surface of the waveguide 10, and this coupling hole 7 is covered with an external cavity resonator 8.

Figure 6A:
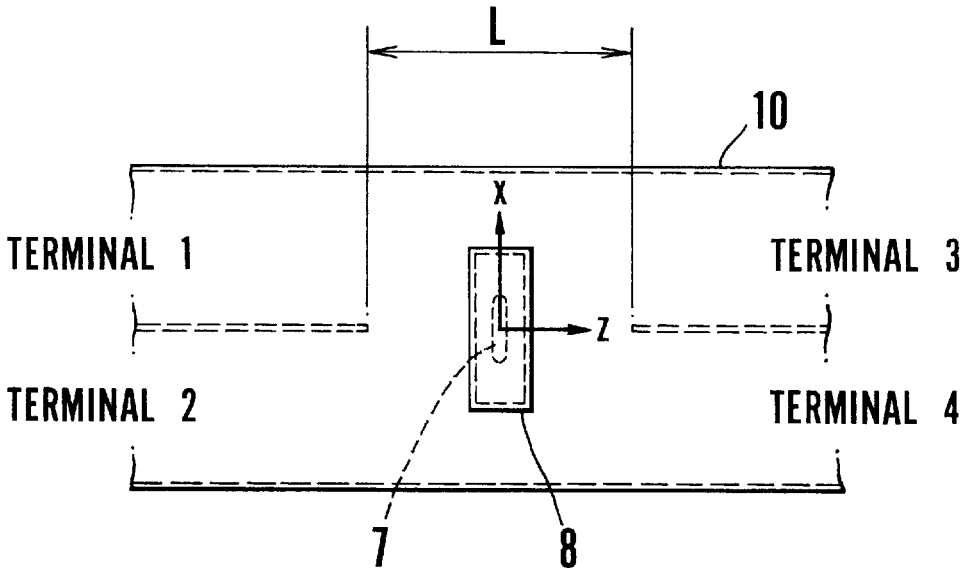
FIGS. 6A and 6B are a plan view and a sectional view, respectively, of the waveguide hybrid junction shown in FIG. 5.
Figure 6B:
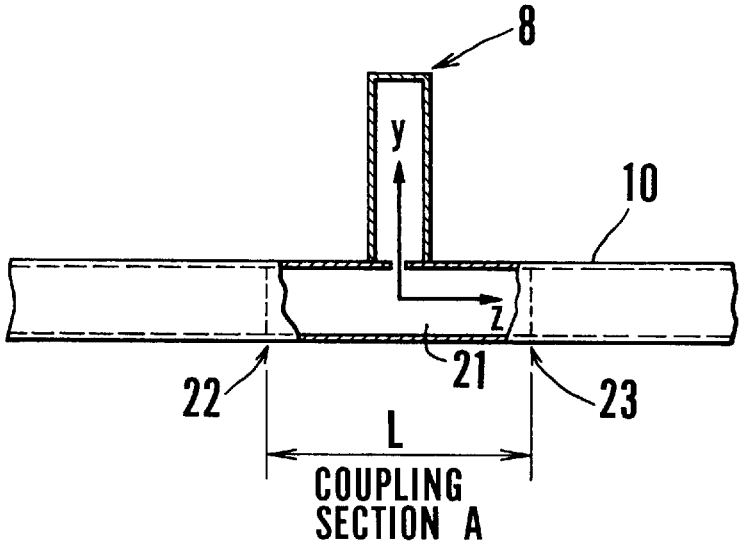

FIGS. 6A and 6B are a plan view and a sectional view, respectively, for explaining the arrangement of the waveguide hybrid junction of the present invention. As shown in FIGS. 6A and 6B, the external cavity resonator 8 is attached in the Y-axis direction perpendicular to the Z-axis direction in which the electric field of the waveguide 10 propagates. The external cavity resonator 8 has the small coupling hole 7 formed in the waveguide 10. The external cavity resonator 8 is arranged at almost the central portion of a coupling section A.

Figure 7:
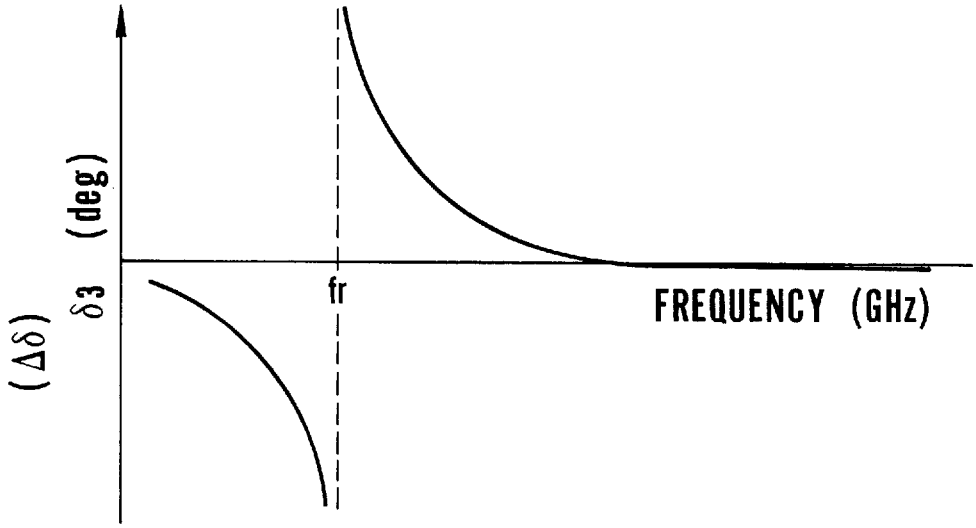
FIG. 7 is a graph showing the frequency characteristics of the phase shift amount in a $TE_{10}$ mode in the waveguide hybrid junction shown in FIG. 5.

FIG. 7 is a graph showing the frequency vs. phase shift characteristics of the waveguide hybrid junction having the external cavity resonator 8 in a $TE_{10}$ mode. In FIG. 7, a phase shift amount $\delta_3$ in the $TE_{10}$ mode by the external cavity resonator 8 abruptly varies near a resonance frequency fr of the resonator. Therefore, the phase shift amount becomes positive at a frequency slightly higher than fr, and negative at a frequency slightly lower than fr.

On the other, the phase shift amount in a $TE_{20}$ mode is regarded as $\delta_4 = 0$ because the external cavity resonator 8 hardly influences a radio wave of $TE_{20}$ mode. The reason why the external cavity resonator 8 influences not a radio wave of $TE_{20}$ mode but only a radio wave of $TE_{10}$ mode in this manner is as follows.

Figure 8A:
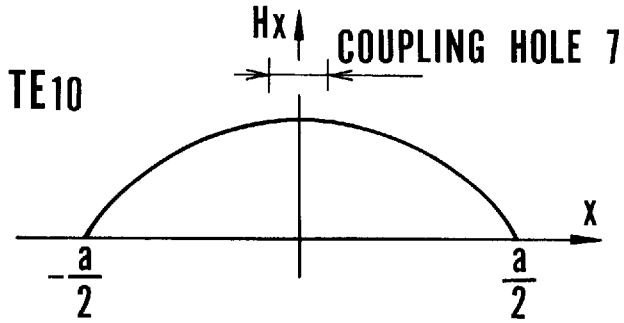
FIGS. 8A to 8C are graphs showing the distributions of magnetic fields in the $TE_{10}$ mode and a $TE_{20}$ mode in the X-axis direction, and a perspective view for schematically explaining the arrangement of the waveguide hybrid junction of the present invention, respectively.
Figure 8B:
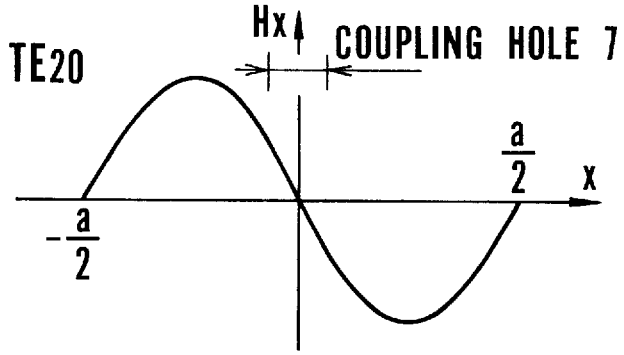

FIGS. 8A and 8B are graphs showing magnetic field components in the X-axis direction in the $TE_{10}$ and $TE_{20}$ modes, respectively. Note that a represents the size of the waveguide 10 in the X-axis direction. In the $TE_{10}$ mode, as power coupled from the waveguide to the external cavity resonator 8 is larger, the influence of the external cavity resonator 8 on the pass phase shift amount increases. The power is proportional to almost the square of a component in the X-axis direction of the magnetic field vector near the small coupling hole 7 (i.e., a component in the longitudinal direction of the small coupling hole 7). For this reason, the distribution of the magnetic field component in the $TE_{10}$ mode is maximized near the small coupling hole 7, as shown in FIG. 8A.

On the other hand, the distribution of a magnetic field component in the $TE_{20}$ mode is almost 0 near the small coupling hole 7, as shown in FIG. 8B. In addition, since this distribution is an odd function, coupling to the external cavity resonator is canceled out on the +X and −X sides with respect to the small coupling hole 7.

As a result, the external cavity resonator does not influence a radio wave of $TE_{20}$ mode. A phase shift difference $\Delta\delta = \delta_3 - \delta_4$ between the $TE_{10}$ and $TE_{20}$ modes upon addition of the external cavity resonator almost coincides with the frequency characteristics of $\delta_3$ in FIG. 7.

Figure 8C:
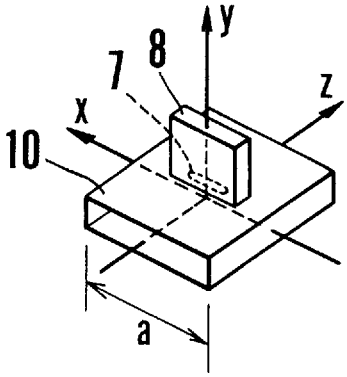

FIG. 8C is a schematic perspective view showing the arrangement of the waveguide hybrid junction of the present invention.

Figure 1:
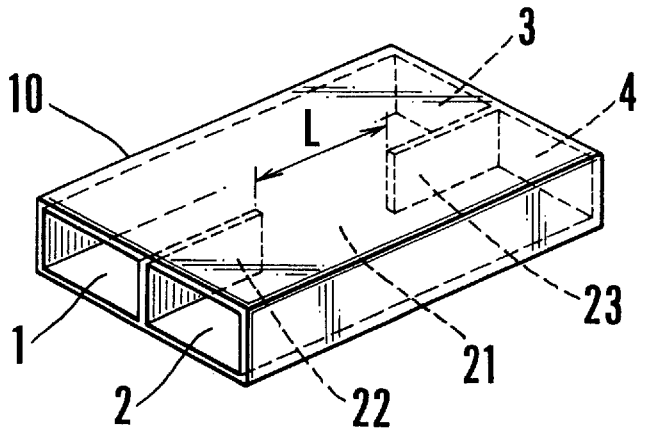
FIG. 1 PRIOR ART
FIG. 1 is a perspective view schematically showing the outer appearance of a waveguide hybrid junction as a prior art.
Figure 2:
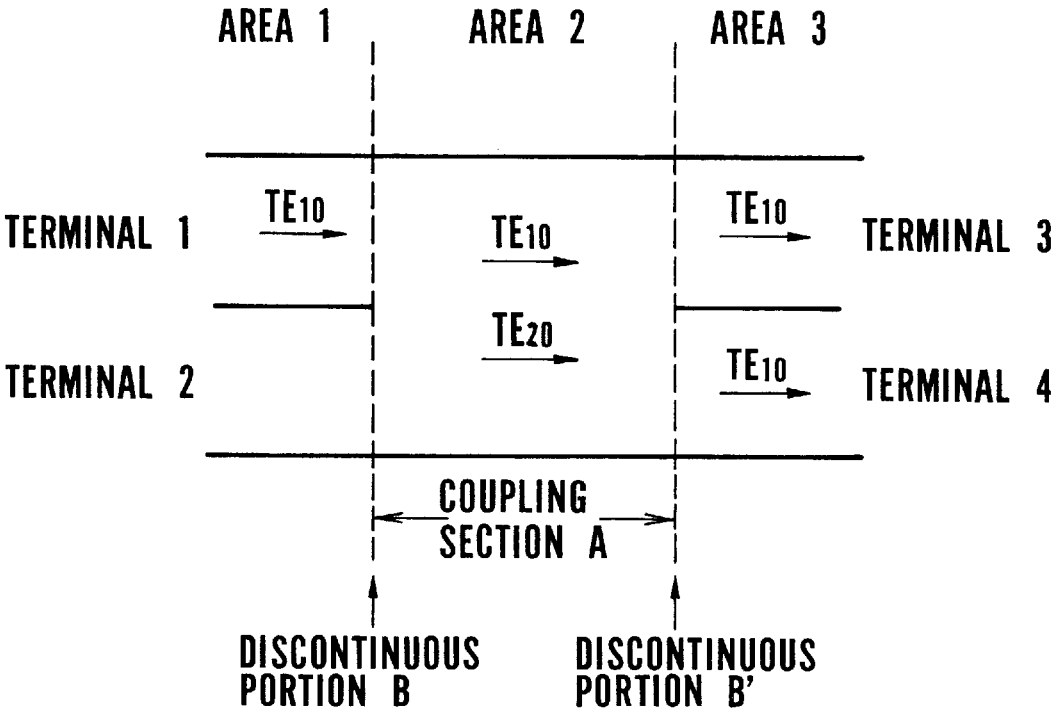
FIG. 2 PRIOR ART
FIG. 2 is an explanatory view for explaining the operation in the prior art shown in FIG. 1.
Figure 3A:
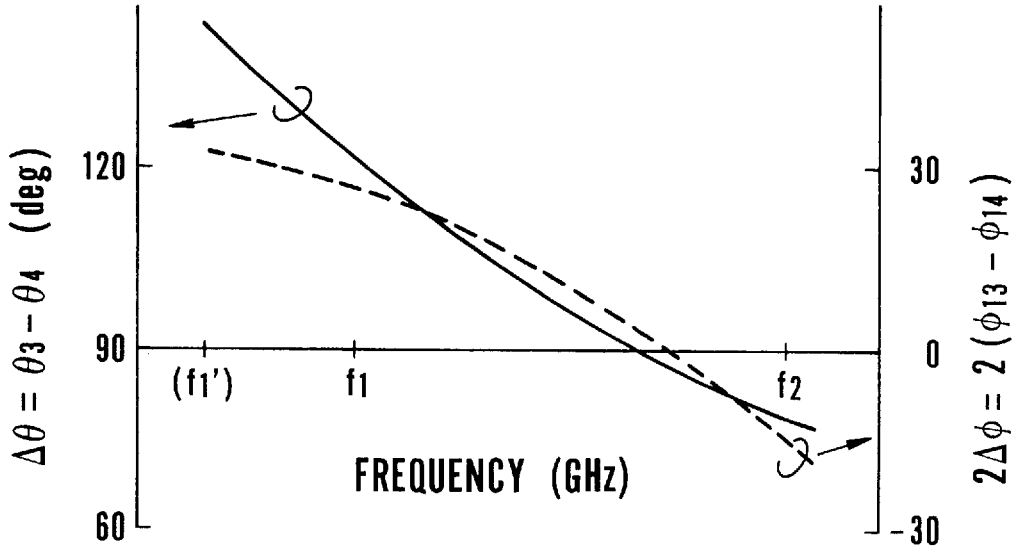
FIG. 3A PRIOR ART
FIGS. 3A and 3B are graphs showing the frequency characteristics of Δθ and Θ in the prior art shown in FIG. 1, respectively.
Figure 3B:
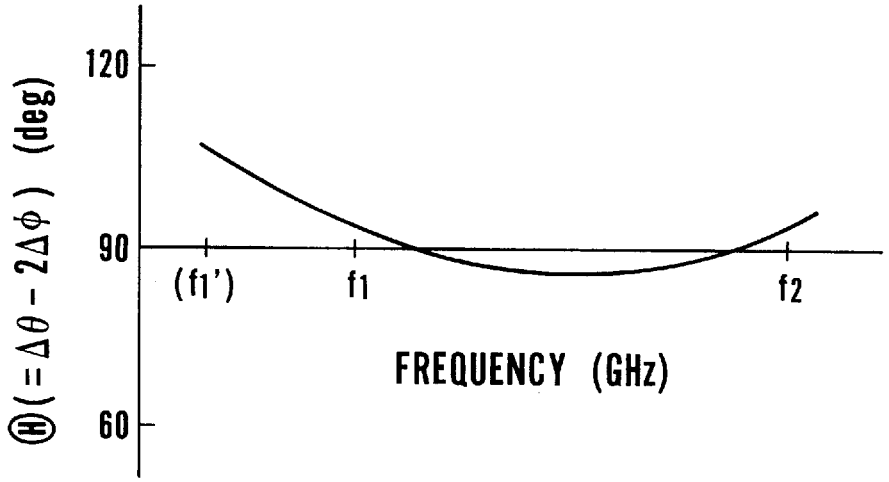
FIG. 3B PRIOR ART
Figure 4:
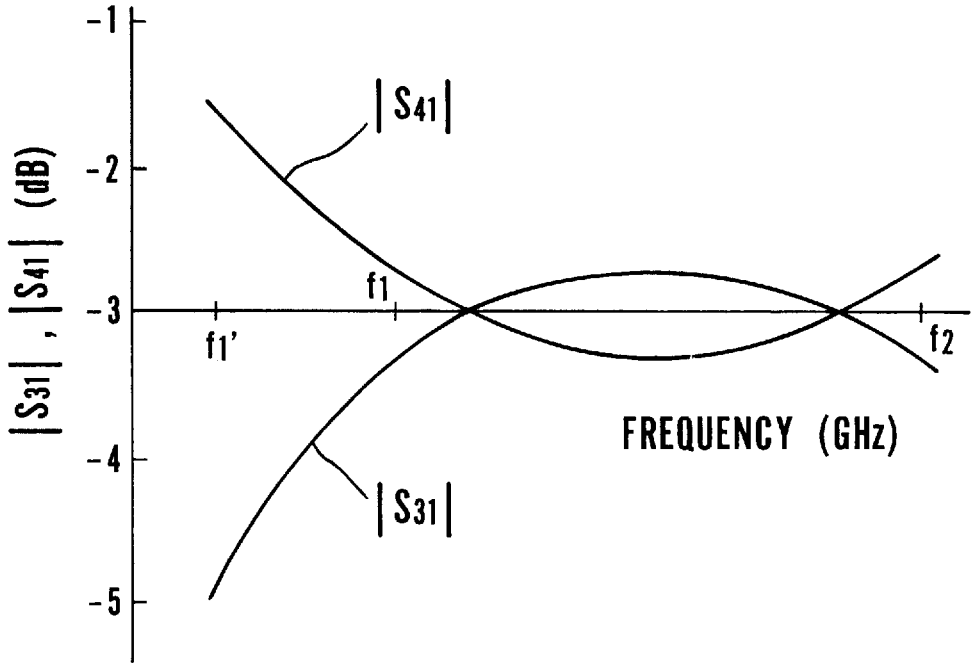
FIG. 4 PRIOR ART
FIG. 4 is a graph showing the frequency characteristics of amplitude characteristics $|S_{31}|$ and $|S_{41}|$ in the prior art shown in FIG. 1.
Figure 9A:
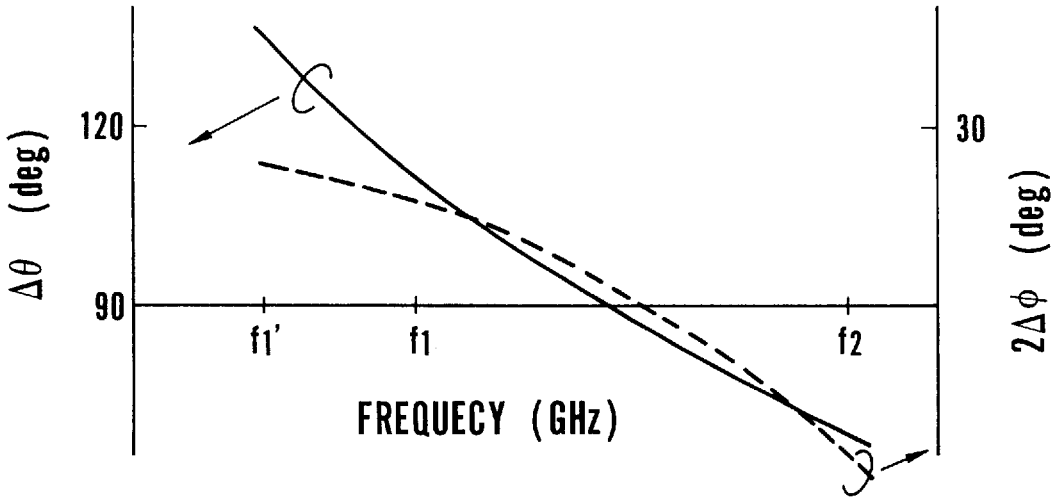
FIGS. 9A to 9C are graphs showing the frequency characteristics of Δθ, Δδ, and Θ in the waveguide hybrid junction shown in FIG. 5, respectively.
Figure 9B:
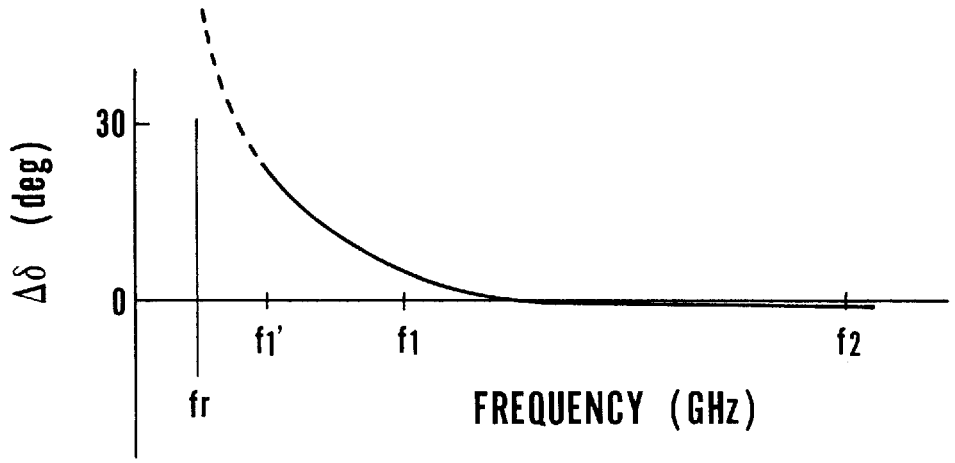
Figure 9C:
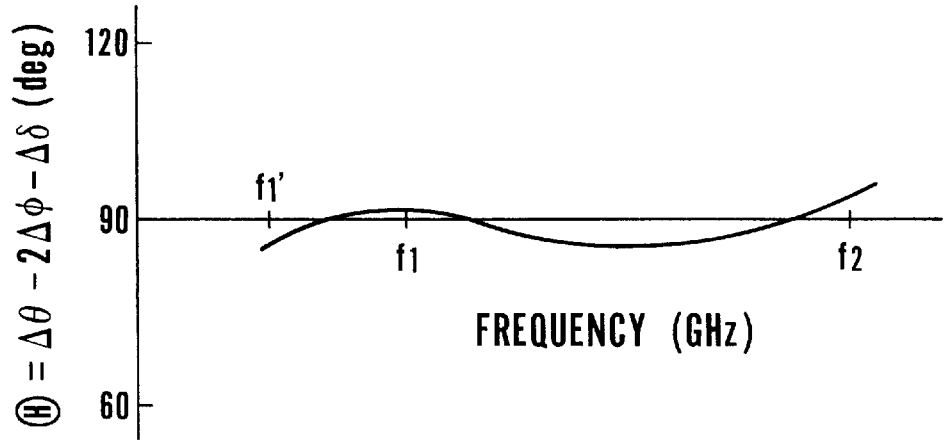

FIGS. 9A to 9C are graphs, respectively, showing the frequency vs. phase shift amount characteristics of the waveguide hybrid junction having the external cavity resonator. FIG. 9A corresponds to the phase shift amount characteristics at the coupling section A and the discontinuous portions of the conventional waveguide hybrid junction shown in FIG. 3A. FIG. 9B shows the characteristics of $\Delta\delta$ in which the phase shift amount greatly changes to be positive at a frequency higher than the resonance frequency, as described in FIG. 7.

The total phase shift amount of the waveguide hybrid junction of the present invention is given by $$\Theta = \Delta\theta - 2\Delta\phi - \Delta\delta \tag{8}$$

FIG. 9C shows characteristics obtained by calculating the difference between the total phase shift amounts $\Theta$ in the respective modes on the basis of equation (8). As a result, the degradation in phase shift amount can be compensated by the characteristics of $\Delta\delta$ in the frequency band of $f_1'$ to $f_1$ slightly higher than the resonance frequency fr, and a phase shift difference of almost 90° can be ensured over a broad band.

Figure 10:
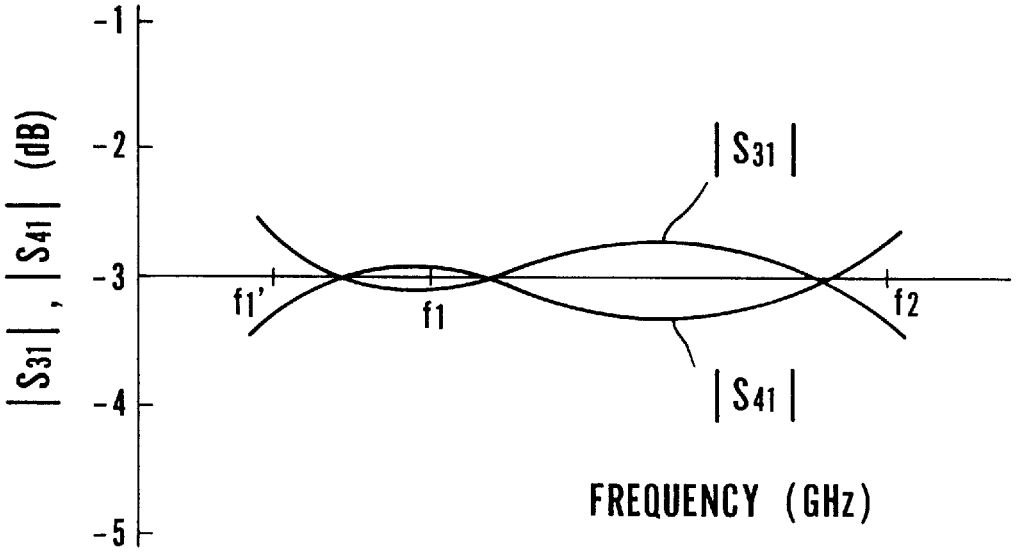
FIG. 10 is a graph showing the frequency characteristics of amplitude characteristics $|S_{31}|$ and $|S_{41}|$ in the waveguide hybrid junction shown in FIG. 5.

Similarly, it is shown in FIG. 10 that the frequency bands of amplitude characteristics $|S_{31}|$ and $|S_{41}|$ are broadened.

Note that the characteristics of $\Delta\delta$ depend on the sizes of the small coupling hole 7 and the external cavity resonator 8. By properly adjusting these sizes, the above compensation effect can be sufficiently enhanced.

In this embodiment, the operation frequency band of the waveguide hybrid junction is broadened to the frequency range of $f_1'$ to $f_1$ lower than the frequency band of $f_1$ to $f_2$, so that the effect of broadening a low frequency range can be attained. By setting the center frequency of the frequency band of $f_1$ to $f_2$ to a lower frequency in consideration of this effect, the operation frequency band can be broadened to a frequency range substantially higher than the center frequency, as a matter of course.

The first embodiment of the present invention described above exemplifies the arrangement in which one external cavity resonator 8 is attached to the rectangular waveguide. The external cavity resonator is not limited to this. That is, two external cavity resonators can be attached as in the second embodiment of the present invention.

Figure 11:
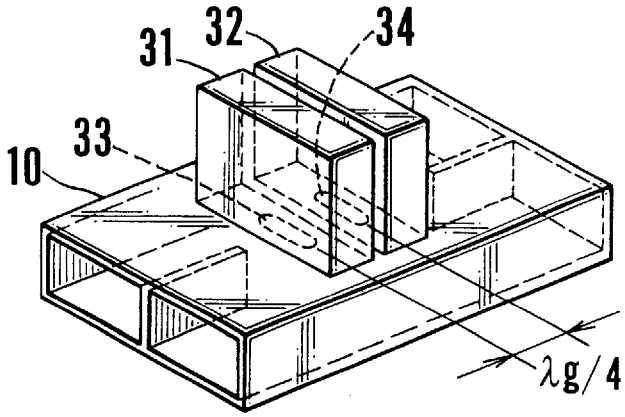
FIG. 11 is a perspective view schematically showing the outer appearance of a waveguide hybrid junction according to the second embodiment of the present invention.

FIG. 11 is a perspective view schematically showing a waveguide hybrid junction according to the second embodiment of the present invention.

As shown in FIG. 11, external cavity resonators 31 and 32 are arranged parallel to each other at a coupling section A. The external cavity resonators 31 and 32 have first and second small coupling holes 33 and 34, respectively.

The interval between the external cavity resonators 31 and 32 is set to $\lambda g/4$ where $\lambda g$ represents the intra-waveguide wavelength in a $TE_{10}$ mode at the coupling portion A.

By arranging the two external cavity resonators 31 and 32, the following effect can be obtained.

More specifically, in the arrangement shown in FIG. 5, the compensation amount ($\Delta\delta$) of $\Theta$ is generated by adding the external cavity resonator 8. If this compensation amount is small, no problem arises. If this compensation amount increases, the characteristics of the overall waveguide hybrid junction are degraded by reflected waves. However, these reflected waves can be canceled out by arranging the two external cavity resonators, as shown in FIG. 11. Therefore, the influence of reflection caused by adding a cavity resonator can be eliminated.

Figure 12:
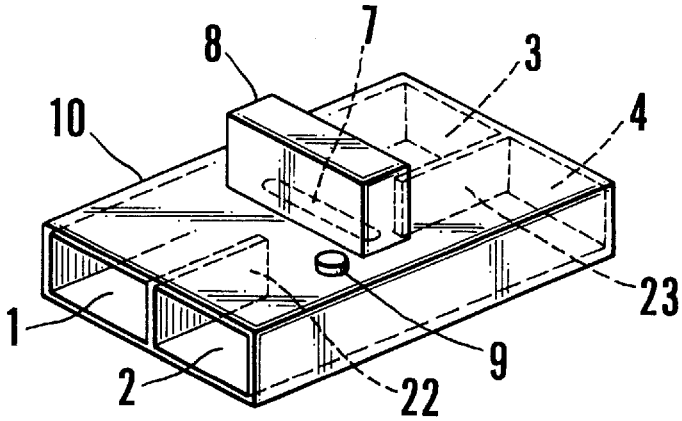
FIG. 12 is a perspective view schematically showing the outer appearance of a waveguide hybrid junction according to the third embodiment of the present invention.

In the third embodiment of the present invention, as shown in FIG. 12, a matching element 9 is arranged at the coupling portion A in the embodiment of FIG. 5 to further broaden the frequency band. That is, a capacitive susceptance or an inductive reactance (e.g., a conductive rod) which does not influence a radio wave of $TE_{20}$ mode is inserted as a matching element at the coupling section A to avoid reflection and attain a broad band. Therefore, a waveguide hybrid junction having a band broadened by adding an external cavity resonator and a matching element can be provided.

What we claimed is:

1. A short slot hybrid junction comprising:

two rectangular waveguides having a common side wall with an opening therein, a coupling section of the junction being defined by a length of said opening and a combined width of said two waveguides;

a top wall of said coupling section having a slotted coupling hole therein for communicating with said coupling section, said slotted coupling hole having a longitudinal axis that is generally perpendicular to a plane of said common side wall; and an external cavity resonator covering said slotted coupling hole, said resonator having a length greater than its width and a longitudinal axis that is generally parallel to the longitudinal axis of said slotted coupling hole.

2. The junction according to claim 1, wherein sizes of the coupling hole and said external cavity resonator are adjusted to compensate amplitude and phase shift-to-frequency characteristics of said hybrid junction.

3. The junction according to claim 1, wherein the length of the coupling section is such that a phase shift difference caused at the coupling section becomes almost 90°.

4. The junction of claim 1, further comprising a second slotted coupling hole in the top wall of said coupling section and a second external cavity resonator covering said second slotted coupling hole.

5. The junction of claim 1, wherein said resonator is generally rectangular.

6. The junction of claim 1, wherein a center of said slotted coupling hole is approximately centered in the top wall of said coupling section.

7. The junction of claim 1, further comprising a matching element in the coupling section, spaced from said resonator.

8. A short slot hybrid junction comprising:

two rectangular waveguides having a common side wall with an opening therein, a coupling section of the junction being defined by a length of said openings and a combined width of said two waveguides;

a top wall of said coupling section having first and second coupling holes in a central portion thereof for communicating with said coupling section; and a first and second external cavity resonators covering a respective one of said first and second coupling holes, each of said resonators having a length greater than its width and a longitudinal axis that is generally perpindicular to a plane of said common side wall.

9. The junction according to claim 8, wherein sizes of the first and second coupling holes and said first and second external cavity resonators are adjusted to compensate amplitude and phase shift-to-frequency characteristics of said junction.

10. The junction according to claim 8, wherein said first and second external cavity resonators are arranged parallel to each other to be spaced apart by ¼ an intra-waveguide wavelength at the coupling section in a $TE_{10}$ mode.

11. The junction according to claim 8, wherein the length of the coupling section is such that a phase shift difference caused at the coupling section becomes almost 90°.

12. The junction of claim 8, wherein said first and second coupling holes are slots with longitudinal axes generally perpendicular to the plane of said common side wall.

13. The junction of claim 8, wherein said first and second resonators are generally rectangular.

* * * * *